US009629421B2

(12) United States Patent
Kaikou et al.

(10) Patent No.: US 9,629,421 B2
(45) Date of Patent: Apr. 25, 2017

(54) FABRIC SURFACE FASTENER IN WHICH BOTH SIDES JOIN TOGETHER

(71) Applicant: KURARAY FASTENING CO., LTD., Osaka-shi (JP)

(72) Inventors: Takayoshi Kaikou, Fukui (JP); Masami Yamashita, Fukui (JP); Kazuya Maeda, Fukui (JP)

(73) Assignee: Kuraray Fastening Co., Ltd., Osaka-shi (JP)

( * ) Notice: Subject to any disclaimer, the term of this patent is extended or adjusted under 35 U.S.C. 154(b) by 73 days.

(21) Appl. No.: 14/431,989

(22) PCT Filed: Aug. 16, 2013

(86) PCT No.: PCT/JP2013/004873
§ 371 (c)(1),
(2) Date: Mar. 27, 2015

(87) PCT Pub. No.: WO2014/049940
PCT Pub. Date: Apr. 3, 2014

(65) Prior Publication Data

US 2015/0196100 A1 Jul. 16, 2015

(30) Foreign Application Priority Data

Sep. 28, 2012 (JP) ..... 2012-216238

(51) Int. Cl.
*A44B 18/00* (2006.01)

(52) U.S. Cl.
CPC ..... *A44B 18/0023* (2013.01); *A44B 18/0084* (2013.01); *D10B 2501/0632* (2013.01); *Y10T 24/2733* (2015.01)

(58) Field of Classification Search
CPC ..... A44B 18/0023; A44B 18/0003; A44B 18/0084; D10B 2501/0632; Y10T 24/2733
See application file for complete search history.

(56) References Cited

U.S. PATENT DOCUMENTS 3,009,235 A * 11/1961 De Mestral ..... A44B 18/0023 128/DIG. 15
3,594,873 A * 7/1971 Hockmeyer, Jr. .. A44B 18/0034 139/384 B (Continued)

FOREIGN PATENT DOCUMENTS

JP 4 49904 2/1992
JP 2003 61714 3/2003

(Continued)

OTHER PUBLICATIONS

International Search Report Issued Nov. 19, 2013 in PCT/JP13/004873 Filed Aug. 16, 2013.

*Primary Examiner* — Robert J Sandy
(74) *Attorney, Agent, or Firm* — Oblon, McClelland, Maier & Neustadt, L.L.P.

(57) ABSTRACT

A double-sided engagement type fabric surface fastener, which includes a base fabric, hook-like engagement elements that exist on the top surface of the base fabric, and loop-like engagement elements that exist on the bottom surface of the base fabric, where a ground warp yarn and a ground weft yarn constituting the base fabric, the hook-like engagement elements, and the loop-like engagement elements are all yarns made of polyester resin, the ground weft yarn contains core-sheath type thermal adhesive polyester fibers, and the hook-like engagement elements and the loop-like engagement elements are both fixed to the base fabric by the thermal adhesive fibers constituting the base fabric.

9 Claims, 1 Drawing Sheet

(56) References Cited

U.S. PATENT DOCUMENTS

| | | | | |
|---|---|---|---|---|
| 4,822,658 | A * | 4/1989 | Pacione | A47G 27/0437 428/100 |
| 5,231,738 | A * | 8/1993 | Higashinaka | A44B 18/003 24/446 |
| 5,745,961 | A * | 5/1998 | Okawa | A44B 18/0023 24/442 |
| 5,879,335 | A * | 3/1999 | Martinez | A61M 25/02 604/179 |
| 2001/0035225 | A1 | 11/2001 | Okawa | |
| 2003/0106189 | A1 | 6/2003 | Okawa et al. | |
| 2003/0150087 | A1* | 8/2003 | Dieterich | A44B 18/0084 24/306 |
| 2006/0016506 | A1* | 1/2006 | Okawa | A44B 18/0023 139/383 R |
| 2008/0289157 | A1 | 11/2008 | Higashinaka et al. | |

FOREIGN PATENT DOCUMENTS

| | | |
|---|---|---|
| JP | 2004 351106 | 12/2004 |
| JP | 3647357 | 5/2005 |
| JP | 4690315 | 6/2011 |
| JP | 2011 245045 | 12/2011 |
| WO | 2007 074791 | 7/2007 |

* cited by examiner

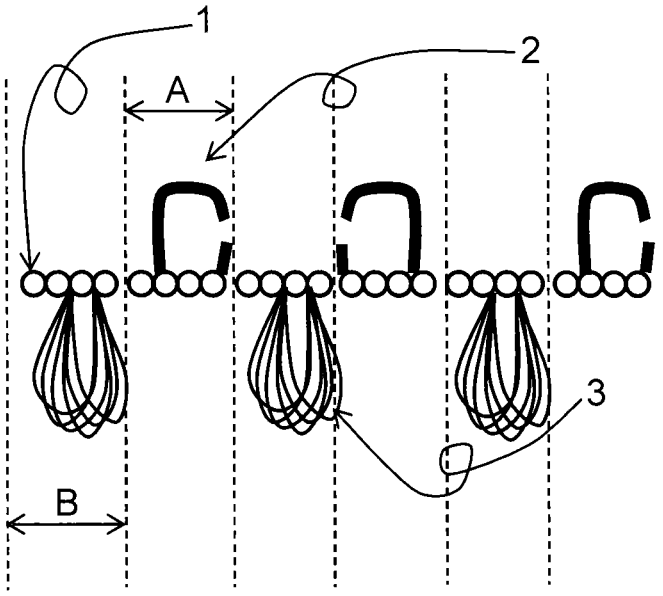
1
2
A
3
B

FABRIC SURFACE FASTENER IN WHICH BOTH SIDES JOIN TOGETHER

TECHNICAL FIELD

The present invention relates to a double-sided engagement type fabric surface fastener, in which hook-like engagement elements constituted of polyester fibers exist on one surface of a base fabric, and loop-like engagement elements exist on the other surface of the base fabric, wherein the fabric surface fastener has good external appearance, engaging strength, and durability.

BACKGROUND ART

Conventionally, there is known a double-sided engagement type fabric surface fastener, in which hook-like engagement elements exist on a top surface of a base fabric, and loop-like engagement elements exist on a bottom surface of the base fabric. As compared with a conventional surface fastener, which is manufactured by attaching two types of surface fasteners respectively provided with hook-like engagement elements and loop-like engagement elements on surfaces thereof, to both surfaces of a support base fabric, the double-sided engagement type fabric surface fastener is constituted of one type of surface fasteners. Therefore, in recent years, a demand for the double-sided engagement type fabric surface fastener has been increasing.

In the double-sided engagement type fabric surface fastener, it is very important to fix the engagement elements to a base fabric so that the engagement elements are not pulled out of the base fabric. For instance, as a representative example, Patent Literature 1 describes a surface fastener provided with engagement elements on both surfaces thereof, wherein the engagement elements are fixed to a base fabric by coating, on the surface fastener, liquid or emulsion liquid containing polyurethane resin, acrylic resin, ASB resin, SB resin, polyester resin, silicon resin, or the like by an airless spray method.

Patent Literature 2 describes a surface fastener provided with engagement elements on both surfaces thereof, wherein the engagement elements are fixed to a base fabric, with use of a hot melt adhesive in the form of powders and containing ethylene vinyl acetate, polyethylene, atactic polypropylene, ethylene-acrylic acid, copolyamide, copolyester, or the like.

Patent Literature 3 describes a surface fastener provided with engagement elements on both surfaces thereof, wherein the engagement elements are fixed to a base fabric with use of a thermal adhesive yarn as a part of a ground warp yarn, or heat melt resin powder having a low melting point.

Patent Literature 4 describes a double woven cloth constituted of a top base fabric and a bottom base fabric, wherein the fabrics are integrally adhered by weaving a yarn for engagement elements, weaving a thermal adhesive yarn having a low melting point, and subjecting the yarns to heat melting.

In the manufacturing methods described in Patent Literature 1 and Patent Literature 2, an adhesive is coated on one of the surfaces of the base fabric of the surface fastener having engagement elements on both surfaces thereof. In other words, an adhesive is coated on the surface having hook-like engagement elements or on the surface having loop-like engagement elements. In this case, if an adhesive is coated on a multifilament yarn constituting loop-like engagement elements, fibers constituting the multifilament yarn are bundled and fixed to a monofilament form by the adhesive. This may result in great loss of engaging performance. Therefore, normally, a method of coating an adhesive on the surface having hook-like engagement elements is employed. Coating an adhesive on a hook-like engagement element surface, however, may naturally cause adhesion of adhesive to the surface of a yarn for hook-like engagement elements.

A hook-like engagement element is formed into a hook shape by forming a monofilament yarn into a loop shape, and cutting a leg portion of the loop into a hook shape. The process of cutting leg portions of monofilament loops is carried out after fixing a yarn for engagement elements to a base fabric by an adhesive or the like. Specifically, in the manufacturing methods in Patent Literature 1 and Patent Literature 2, hook-like engagement elements are formed by cutting loops of a monofilament yarn to which an adhesive is adhered. In the process of cutting a monofilament yarn to which an adhesive is adhered, a cutting blade may peel off a part of the adhesive adhered to the monofilament yarn. Partly peeled-off adhesive may remain on the hook-like engagement elements, and it looks like dust fell on the hook-like engagement elements. This may impair the external appearance. If the amount of adhesive to be coated is reduced in an attempt to suppress deterioration of the external appearance, the engagement elements are likely to be pulled out of the base fabric by repeated engagement and disengagement. This may greatly lower the durability.

Further, in the techniques described in Patent Literature 3 and Patent Literature 4, a thermal adhesive yarn is used as a part of a ground warp yarn. When yarns of different properties are used as a ground warp yarn, crease may be generated on a surface fastener because of different heat shrinkage rates between the yarns. If the dyeing properties differ between the yarns, streaks of uneven colors may appear. This may impair the external appearance. Further, if a thermal adhesive yarn is used as a ground warp yarn, a yarn for engagement elements that is woven in parallel to a ground warp yarn may not be securely fixed to the base fabric, and the engagement elements are likely to be pulled out of the base fabric by engagement and disengagement. This may deteriorate the durability.

The present inventors have found that in a double-sided engagement type fabric surface fastener having hook-like engagement elements and loop-like engagement elements respectively on a top surface and a bottom surface of a base fabric, use of a thermal adhesive yarn as a ground weft yarn eliminates the need of coating an adhesive on the base fabric, and eliminates the need of using a thermal adhesive yarn as a ground warp yarn. This makes it possible to obtain a double-sided engagement type fabric surface fastener having good durability, engaging strength, and external appearance.

Conventionally, nylon fibers are dedicatedly used as a material for a surface fastener. It is known that when nylon fibers are used as a material for hook-like engagement elements, loop-like engagement elements, a ground warp yarn, or a ground weft yarn, wet dimensional stability may be deteriorated, and the surface fastener may have a wavy appearance by absorbing water.

Further, in a conventional surface fastener, resistance against pulling out of engagement elements is obtained by coating an adhesive on a base fabric, so that hook-like engagement elements and loop-like engagement elements are not pulled out of the base fabric by engagement and disengagement. When an adhesive is coated on a base fabric, the base fabric becomes rigid because the base fabric is hardened by the adhesive. A rigid base fabric is not favorable in the garment field where softness is required.

There is reported a technique such that thermal adhesive fibers are used as fibers constituting a surface fastener, and fibers for engagement elements in a base fabric are adhered by melting the thermal adhesive fibers in order to enhance the resistance against pulling out of engagement elements (see Patent Literature 5). When polyamide fibers are used as fibers constituting a base fabric, however, the fiber performance may be greatly deteriorated by thermal adhesion treatment, because the polyamide fibers have a poor heat resistance.

CITATION LIST

Patent Literature

Patent Literature 1: Japanese Unexamined Patent Publication No. Hei 4-49904

Patent Literature 2: Japanese Unexamined Patent Publication No. 2003-61714

Patent Literature 3: Japanese Unexamined Patent Publication No. 2004-351106

Patent Literature 4: Japanese Patent No. 3647357

Patent Literature 5: Japanese Patent No. 4690315

SUMMARY OF INVENTION

In view of the above, an object of the present invention is to provide a double-sided engagement type fabric surface fastener having hook-like engagement elements and loop-like engagement elements respectively on a top surface and a bottom surface thereof, wherein the double-sided engagement type fabric surface fastener has a good engaging strength and good durability, specifically, the engagement elements are less likely to be pulled out of a base fabric by repeated engagement and disengagement, and the external appearance is not impaired.

The present inventors have found that in a double-sided engagement type fabric surface fastener having hook-like engagement elements and loop-like engagement elements respectively on a top surface and a bottom surface of a base fabric, use of a thermal adhesive yarn as a ground weft yarn eliminates the need of coating an adhesive on the base fabric, and eliminates the need of using a thermal adhesive yarn as a ground warp yarn; and use of polyester fibers as fibers constituting the surface fastener provides a double-sided engagement type fabric surface fastener having good durability, engaging strength, and external appearance.

Specifically, an aspect of the present invention is a double-sided engagement type surface fastener constituted of a base fabric, hook-like engagement elements that exist on a top surface of the base fabric, and loop-like engagement elements that exist on a bottom surface of the base fabric, wherein a ground warp yarn and a ground weft yarn constituting the base fabric, the hook-like engagement elements, and the loop-like engagement elements are all yarns made of polyester resin, the ground weft yarn contains core-sheath type thermal adhesive polyester fibers, and the hook-like engagement elements and the loop-like engagement elements are fixed to the base fabric by the thermal adhesive fibers constituting the base fabric.

According to the present invention, the hook-like engagement elements and the loop-like engagement elements are adhered and fixed by the ground weft yarn constituting the base fabric. Therefore, it is not necessary to coat an adhesive on the top surface or on the bottom surface of the base fabric i.e. on the surfaces where the engagement elements exist. Thus, a double-sided fastener having good external appearance is obtained.

BRIEF DESCRIPTION OF DRAWINGS

FIG. 1 is a sectional view of a double-sided engagement type fabric surface fastener of the present invention, as viewed from a ground weft yarn direction.

DESCRIPTION OF EMBODIMENTS

In the following, an embodiment for carrying out the present invention will be described in detail. The present invention, however, is not limited to the embodiment.

The surface fastener of the embodiment is mainly constituted of a monofilament yarn for hook-like engagement elements, a multifilament yarn for loop-like engagement elements, a ground warp yarn, and a ground weft yarn.

Hook-like engagement elements require rigidity, and hook-shape retainability such that the hook shape is not extended by a slight physical force. In view of the above, a thick monofilament yarn made of synthetic fiber is used. In the embodiment, the monofilament yarn is a monofilament yarn made of polyester, more preferably, polybutylene terephthalate polyester.

Polybutylene terephthalate polyester is polyester constituted of butylene terephthalate units, and is polyester mainly obtained by condensation reaction of terephthalic acid and 1,4-butanediol. It is possible to add a small amount of polymerization units other than terephthalic acid and 1,4-butanediol, as far as the addition does not impair the advantageous effects of the present invention. Representative examples of the polymerization units are aromatic dicarboxylic acids such as isophthalic acid, phthalic acid and naphthalene dicarboxylic acid; aliphatic dicarboxylic acids such as adipic acid and sebacic acid; diols such as ethylene glycol and propylene glycol; and oxycarboxylic acids such as benzoic acid and lactic acid. Further, it is possible to add a small amount of polymers other than the above to polybutylene terephthalate polyester as described above.

The thickness of a polyester monofilament yarn for hook-like engagement elements as described above is preferably in the range of from 0.15 to 0.30 mm in diameter, and more preferably, in the range of from 0.18 to 0.25 mm in diameter in terms of weaving performance in forming hook-like engagement elements. The thickness is slightly smaller than the thickness of a hook-like engagement element of a conventional general surface fastener. However, the small thickness imparts softness to the double-sided engagement type fabric surface fastener.

In the embodiment, a multifilament yarn made of polyester, preferably, polybutylene terephthalate polyester is used as a material for loop-like engagement elements. Polybutylene terephthalate polyester is used for the same reason as described above regarding the hook-like engagement elements.

It is preferable to use a multifilament yarn of 5 to 9 filaments and having a total decitex of 150 to 350 decitex, as the polyester multifilament yarn for loop-like engagement elements. It is preferable to infiltrate thermal adhesive resin into the filaments by decreasing the number of filaments constituting a loop-like engagement element in order to securely fix the loop-like engagement element to a base fabric by thermal adhesion. The number of filaments of the multifilament yarn for loop-like engagement elements in the embodiment is slightly smaller than 10 to 24, which is the number of filaments of a multifilament yarn constituting loop-like engagement elements of a conventional general surface fastener. More preferably, the multifilament yarn in the embodiment is a multifilament yarn of 6 to 8 filaments and having a total decitex of 230 to 330 decitex.

In the embodiment, the multifilament yarn constituting loop-like engagement elements may include a small amount of other filament yarns, in addition to the polybutylene terephthalate polyester multifilament yarn.

In the embodiment, preferably, the height of a hook-like engagement element is in the range of from 1.5 to 3.0 mm, and the height of a loop-like engagement element is in the range of from 1.6 to 4.0 mm. More preferably, the height of a hook-like engagement element is in the range of from 1.5 to 2.5 mm, and the height of a loop-like engagement element is in the range of from 1.6 to 3.0 mm.

In the embodiment, preferably, the density of hook-like engagement elements is in the range of from 15 to 60 elements/$cm^2$ in terms of easiness in entering between loop-like engagement elements, and particularly preferably, in the range of from 20 to 40 elements/$cm^2$. The density of loop-like engagement elements is preferably in the range of 40 to 100 elements/$cm^2$ per multifilament yarn in terms of easiness in securing a high engaging performance, and particularly preferably in the range of from 40 to 70 elements/$cm^2$.

In the embodiment, the ratio of element density between hook-like engagement elements and loop-like engagement elements is important in order to obtain a large engaging strength. The ratio of element density between hook-like engagement elements and loop-like engagement elements is preferably 1:1.3 to 1:4, and more preferably 1:1.5 to 1:3 in order to obtain a high engaging performance. An excess of the density of hook elements or an excess of the density of loop elements over the aforementioned range may fail to obtain a high engaging performance. Conventionally, the ratio between hook-like engagement elements and loop-like engagement elements is generally around 1:1. It should be noted that the range defined in the present invention is out of the general value.

In the embodiment, a monofilament yarn constituting hook-like engagement elements, and a multifilament yarn constituting loop-like engagement elements are inserted in a base fabric in parallel to a ground warp yarn. Loops are locally formed while crossing over a ground warp yarn. Heat is applied in order to fix the loop shape.

In the embodiment, it is preferable to alternately weave a yarn for hook-like engagement elements and a yarn for loop-like engagement elements into a base fabric in parallel to a ground warp yarn in the ground weft yarn direction, specifically, as illustrated in FIG. 1, alternately weave a yarn for hook-like engagement elements and a yarn for loop-like engagement elements into a base fabric, yarn by yarn, without crossing each other or without coming into contact with each other in terms of easiness in entering into counterpart engagement elements.

The respective reference signs in FIG. 1 denote the following.

1: a ground warp yarn of a base fabric

2: a hook-like engagement element

3: a loop-like engagement element

A: an area (array) including a hook-like engagement element, where a ground warp yarn and a yarn for an engagement elements are combined B: an area (array) including a loop-like engagement element, where a ground warp yarn and a yarn for an engagement elements are combined Taking into consideration that the weaving method of sequentially weaving several yarns for hook-like engagement elements and several yarns for loop-like engagement elements into a base fabric is normally employed in manufacturing a surface fastener, in which hook-like engagement elements and loop-like engagement elements coexist on one surface, it is unique to alternately weave a yarn for hook-like engagement elements and a yarn for loop-like engagement elements into a base fabric yarn by yarn in parallel to a ground warp yarn in the ground weft yarn direction.

In the embodiment, as illustrated in FIG. 1, it is preferable to weave a yarn for hook-like engagement elements and a yarn for loop-like engagement elements into a base fabric with respect to each four ground warp yarns, without crossing each other or without coming into contact with each other on the base fabric in terms of fixing the hook-like engagement elements and the loop-like engagement elements respectively to the base fabric.

In the embodiment, as illustrated in FIG. 1, it is preferable to form a hook-like engagement element at a position where a yarn for hook-like engagement elements crosses over three consecutive ground warp yarns, and to form a loop-like engagement element at a position where a yarn for loop-like engagement elements crosses over one ground warp yarn.

In the embodiment, preferably, the surface fastener has a weaving structure such that after a hook-like engagement element is formed, a yarn for hook-like engagement elements sinks under a first succeeding ground weft yarn, floats over a second succeeding ground weft yarn, sinks under a third succeeding ground weft yarn, and floats over the surface of the base fabric between the third succeeding ground weft yarn and a fourth succeeding ground weft yarn, whereby a hook-like engagement element is formed at a position where the yarn for hook-like engagement elements crosses over three consecutive ground warp yarns at a position adjacent to the preceding hook-like engagement element; and after a loop-like engagement element is formed, a yarn for loop-like engagement elements sinks under a first succeeding ground weft yarn and floats over the surface of the base fabric between a second succeeding ground weft yarn, whereby a loop-like engagement element is formed at a position where the yarn for loop-like engagement elements crosses over one ground warp yarn at a position adjacent to the preceding loop-like engagement element in terms of easiness in obtaining a large engaging strength.

In the surface fastener of the embodiment, heat to be applied for fixing the hook shape of hook-like engaging elements, and the loop shape of loop-like engagement elements simultaneously adheres the thermal adhesive fibers constituting the base fabric, whereby the loop-like engagement elements and the hook-like engagement elements are fixed to the base fabric. Therefore, generally, the temperature of heat to be applied is in the range of from 180 to 220° C., which is a temperature at which thermal adhesive fibers are melted, and a temperature at which a monofilament yarn for hook-like engagement elements and a multifilament yarn for loop-like engagement elements are thermally fixed, and preferably, in the range of from 190 to 210° C.

A loop for a hook-like engagement element turns into the hook-like engagement element by cutting one part of a leg portion of the loop. Preferably, a cutting device for use in cutting one part of a loop for a hook-like engagement element in order to form the hook-like engagement element is a device having a structure capable of cutting by reciprocating a movable cutting blade between two fixed blades.

In particular, as illustrated in FIG. 1, in the surface fastener of the embodiment, it is preferable to form a base fabric by alternately using a combination of four ground warp yarns constituting a hook-like engagement element, and a combination of four ground warp yarns constituting a loop-like engagement element in terms of fixing the engagement elements. Specifically, a loop for a hook-like engagement element is formed on the top surface of a base fabric by combining four ground warp yarns and a yarn for hook-like engagement elements, and at a position adjacent to the loop, a loop for a loop-like engagement element is formed on the bottom surface of the base fabric by arranging a combination of four ground warp yarns and a yarn for loop-like engagement elements. Disposing a hook-like engagement element and a loop-like engagement element according to the combination pattern as described above is advantageous in reducing a load on a yarn in weaving, and in sufficiently securing a fixing force to a base fabric by a thermal adhesive yarn.

In the double-sided engagement type fabric surface fastener of the embodiment, it is preferable to use a polyester multifilament yarn, as a ground warp yarn constituting a base fabric. Particularly, a polyethylene terephthalate multifilament yarn having an excellent heat resistance is preferred. It is needless to say that a small amount of copolymerizable component, other polymers, or other filaments may be contained. However, taking into consideration that a ground warp yarn is a yarn that stabilizes the process in manufacturing a surface fastener by sequential existence in the length direction of the surface fastener, a yarn with less change such as shrinkage in a heat treatment condition is preferable. Therefore, a yarn made of homopolymer of polyethylene terephthalate is more preferable.

Regarding the thickness of a multifilament yarn constituting a ground warp yarn, it is preferable to use a multifilament yarn of 12 to 96 filaments and having a total decitex of 75 to 250 decitex, and particularly preferable to use a multifilament yarn of 24 to 48 filaments and having a total decitex of 100 to 200 decitex. A base fabric is formed so that a multifilament yarn has a weaving density of ground warp yarns after heat treatment in the range of from 50 to 90 yarns/cm.

As described above, a monofilament yarn constituting hook-like engagement elements, and a multifilament yarn constituting loop-like engagement elements are woven into a base fabric in parallel to a ground warp yarn. Preferably, the sum of the number of monofilament yarns for hook-like engagement elements, and the number of multifilament yarns for loop-like engagement elements to be woven is in the range of about 3 to 6 with respect to 20 warp yarns (including the monofilament yarns for hook-like engagement elements and the multifilament yarns for loop-like engagement elements), and 1 yarn per 5 warp yarns is particularly preferable.

As a material for the ground weft yarn for use in the base fabric of the surface fastener of the embodiment, it is preferable to use polyester resin capable of securely fixing the root of a monofilament yarn for hook-like engagement elements and the root of a multifilament yarn for loop-like engagement elements to the base fabric by thermal adhesion in the aforementioned heat treatment condition. A preferred example of polyester fibers is polyester fibers having a core-sheath construction in section, in which a core component is not melted but a sheath component is melted in a heat treatment condition. Specifically, a representative example of polyester fibers is core-sheath type polyester fibers, in which a core component is made of polyethylene terephthalate, and a sheath component is made of polyethylene terephthalate copolymer obtained by copolymerizing a large amount (e.g. 20 to 30 mol %) of copolymerizable component as exemplified by isophthalic acid or adipic acid.

It is preferable to set the weight ratio between the core component and the sheath component in the range of from 5:5 to 8:2. The weight ratio of thermal adhesive fibers with respect to the fibers constituting a ground weft yarn is preferably in the range of from 25 to 100% by weight. In particular, it is most preferable to constitute substantially all the ground weft yarns of thermal adhesive fibers. If the amount of the core component is small, the surface fastener is likely to be torn in the length direction. If the amount of the sheath component is small, the adhesive fixing force may be lowered.

In order to securely fix hook-like engagement elements and loop-like engagement elements to a base fabric, it is preferable to fasten the root of the hook-like engagement elements and the root of the loop-like engagement elements by thermally adhering the thermal adhesive fibers used as a ground weft yarn, and by shrinking the fibers themselves at the time of thermal adhesion. In view of the above, preferably, the thermal adhesive fibers to be used as a ground weft yarn are fibers having a large heat shrinkage rate in a heat treatment condition. Specifically, it is preferable to use fibers having a dry heat shrinkage rate in the range of from 10 to 20% when the fibers are heated for one minute at 200° C., and particularly preferable to use fibers having a dry heat shrinkage rate in the range of from 12 to 16% in the same condition.

Regarding the thickness of a multifilament yarn constituting a ground weft yarn, it is preferable to use a multifilament yarn of 12 to 72 filaments and having a total decitex of 80 to 300 decitex, and particularly preferable to use a multifilament yarn of 15 to 48 filaments and having a total decitex of 100 to 250 decitex. It is preferable to weave the multifilament yarn into a base fabric so that the weaving density after heat treatment is in the range of from 15 to 25 yarns/cm. Further, it is preferable to set the weigh ratio of a ground weft yarn with respect to the total weight of a monofilament yarn for hook-like engagement elements, a multifilament yarn for loop-like engagement elements, a ground warp yarn, and a ground weft yarn constituting a surface fastener in the range of from 15 to 40%.

As described above, the surface fastener of the embodiment has a feature that the engagement elements are fixed by thermally adhering the fibers constituting a base fabric, and the engagement elements are further securely fixed by heat shrinkage. Thus, the surface fastener is suitable as a surface fastener, in which an adhesive is not coated on a base fabric. It is needless to say, however, the surface fastener is also applicable to a conventional surface fastener, in which an adhesive is coated on a base fabric.

As a weaving structure of a base fabric, it is preferable to use plain fabrics, in which a monofilament yarn for hook-like engagement elements and a multifilament yarn for loop-like engagement elements constitute a part of a ground warp yarn.

The surface fastener of the embodiment is constituted of polyester fibers. Therefore, it is possible to uniformly dye the fastener without causing uneven colors.

The hook-and-loop integral fastener of the embodiment can be used in a variety of fields, in which the conventional surface fasteners are used. For instance, the surface fastener of the embodiment can be used for supporters, a variety of toys, fixation of sheets in construction works, fixation of various panels and wall members, fixation of solar cells to roofs, fixation of electrical components, small articles, and curtains. The hook-and-loop faster of the embodiment is particularly applicable to clamping bands.

In the double-sided engagement type fabric surface fastener of the embodiment, the surface on which hook-like engagement elements exist, and the surface on which loop-like engagement elements exist are integrally formed. Therefore, the surface fastener of the embodiment has an advantage that the surface fastener is engaged and bundled simply by spirally winding the surface fastener in such a manner that the hook-like engagement element surface and the loop-like engagement element surface partially overlap each other. Thus, the surface fastener can be suitably used for packing and cable bundling. Further, it is possible to strongly bundle an article to be bundled by winding a tape-like article attached with the surface fastener of the embodiment on both ends of the tape-like article around the article to be bundled, and by overlapping the top surface and the bottom surface of the surface fastener each other at both ends of the tape-like article.

The present specification discloses various aspects of technology as described above, the primary technology of which is summarized below.

One aspect of the present invention is a double-sided engagement type fabric surface fastener constituted of a base fabric, hook-like engagement elements that exist on a top surface of the base fabric, and loop-like engagement elements that exist on a bottom surface of the base fabric. In the surface fastener, a ground warp yarn and a ground weft yarn constituting the base fabric, the hook-like engagement elements, and the loop-like engagement elements are all yarns made of polyester resin. The ground well yarn contains core-sheath type thermal adhesive polyester fibers. The hook-like engagement elements and the loop-like engagement elements are both fixed to the base fabric by the thermal adhesive fibers constituting the base fabric.

According to the above configuration, the hook-like engagement elements and the loop-like engagement elements are adhered and fixed by the ground well yarn constituting the base fabric. Therefore, it is not necessary to coat an adhesive on the top surface or on the bottom surface of the base fabric, namely, on the surfaces where the engagement elements exist. Thus, it is possible to obtain a double-sided surface fastener having good external appearance.

Further, in the hook-and-loop integral fastener of the present invention, the ground warp yarn and the ground well yarn constituting the base fabric, a monofilament yarn constituting the hook-like engagement elements, and a multifilament yarn constituting the loop-like engagement elements are all yarns made of polyester fibers. Therefore, the engagement elements are securely thermally adhered and fixed by the ground weft yarn. Thus, the above configuration is advantageous in enhancing durability of engagement elements, and in securing a large engaging strength.

According to the present invention, the ground well yarn and the ground warp yarn constituting the base fabric are both yarns made of polyester fibers. Therefore, unlike a configuration of using polyamide fibers, there is no likelihood that the fiber performance may be greatly lowered by thermal degradation when the fibers are thermally adhered, or the surface fastener may have a wavy appearance by moisture.

In the hook-and-loop integral fastener of the present invention, it is not necessary to coat an adhesive for use in fixing the engagement elements on the base fabric. Therefore, the surface fastener has the advantages such as softness and good external appearance. Thus, the surface fastener can also be used in the fields, in which softness and luster are required. Further, substantially all the fibers constituting the surface fastener are polyester fibers. Therefore, it is possible to substantially uniformly dye the fibers by one dyeing process when the fibers are dyed. Unlike a conventional surface fastener, the surface fastener of the present invention is free from a drawback such as generation of uneven colors based on a difference in dyeing performance, resulting from inclusion of fibers of different types.

In the double-sided engagement type fabric surface fastener, preferably, a ratio of element density between the hook-like engagement elements and the loop-like engagement elements may be in a range of from 1:1.3 to 1:4. The above configuration is advantageous in obtaining a large engaging strength and in obtaining high durability.

In the double-sided engagement type fabric surface fastener, preferably, a yarn for hook-like engagement elements and a yarn for loop-like engagement elements may be alternately woven into the base fabric in parallel to the ground warp yarn in a ground well yarn direction in terms of easiness in entering into counterpart engagement elements.

In the double-sided engagement type fabric surface fastener, preferably, a yarn for hook-like engagement elements and a yarn for loop-like engagement elements may be alternately woven into the base fabric with respect to each four ground warp yarns, and the yarn for hook-like engagement elements and the yarn for loop-like engagement elements do not cross each other or do not come into contact with each other on the base fabric. According to the above configuration, the hook-like engagement elements and the loop-like engagement elements are respectively fixed to the base fabric.

In the double-sided engagement type fabric surface fastener, the hook-like engagement element may be formed at a position where a yarn for hook-like engagement element crosses over three consecutive ground warp yarns, and the loop-like engagement element may be formed at a position where a yarn for loop-like engagement elements crosses over one ground warp yarn. The above configuration is advantageous in obtaining an easily engageable surface fastener.

In the double-sided engagement type fabric surface fastener, preferably, the fabric surface fastener may have a weaving structure such that after a hook-like engagement element is formed, the yarn for hook-like engagement elements sinks under a first succeeding ground well yarn, floats over a second succeeding ground well yarn, sinks under a third succeeding ground well yarn, and floats over the surface of the base fabric between the third succeeding ground weft yarn and a fourth succeeding ground weft yarn, whereby a hook-like engagement element is formed at a position where the yarn for hook-like engagement elements crosses over three consecutive ground warp yarns at a position adjacent to the preceding hook-like engagement element, and after a loop-like engagement element is formed, the yarn for loop-like engagement elements sinks under a first succeeding ground weft yarn, and floats over the surface of the base fabric between the first weft yarn and a second succeeding ground weft yarn, whereby a loop-like engagement element is formed at a position where the yarn for loop-like engagement elements crosses over one ground warp yarn at a position adjacent to the preceding loop-like engagement element.

The above configuration is advantageous in obtaining a large engaging strength.

In the double-sided engagement type fabric surface fastener, preferably, the yarn for hook-like engagement elements may be a monofilament yarn, the yarn for loop-like engagement elements may be a multifilament yarn, and the yarn for hook-like engagement elements and the yarn for loop-like engagement elements may be both yarns made of polybutylene terephthalate resin.

According to the above configuration, the softness of the yarns makes it easy to separate the filaments of the loop-like engagement elements from each other. This makes it easy for the hook-like engagement elements to engage with the filaments of the loop-like engagement elements. This is advantageous in obtaining a large engaging strength with a less load.

Use of polyethylene terephthalate polyester fibers as a material for a monofilament yarn constituting hook-like engagement elements has several drawbacks such that part of the filaments of a yarn for loop-like engagement elements is pulled out of the base fabric portion due to repeated engagement and disengagement, which may impair the external appearance, and may lower the durability, despite that a large engaging strength is obtained. According to the present invention, preferably, a monofilament yarn constituting hook-like engagement elements may be made of polybutylene terephthalate polyester having softness. Thus, resistance against pulling out of engagement elements is improved.

In the double-sided engagement type fabric surface fastener, preferably, the yarn for hook-like engagement elements may be a monofilament yarn having a diameter in a range of from 0.15 to 0.30 mm, and the yarn for loop-like engagement elements may be a multifilament yarn of 5 to 9 filaments and having a total decitex of 150 to 350 decitex.

Infiltrating thermal adhesive resin into the filaments by reducing the number of filaments constituting loop-like engagement elements as described above is advantageous in securely fixing the loop-like engagement elements to the base fabric by thermal adhesion.

EXAMPLES

In the following, the present invention is described by way of examples. The present invention, however, is not limited by these examples. In the examples, the dry heat shrinkage rate was measured in accordance with JIS L1013 standard, and the engaging strength was measured with respect to a surface fastener having a width of 80 mm in accordance with JIS L3416 standard.

Example 1

As a ground warp yarn and a ground weft yarn constituting a base fabric of a surface fastener, a monofilament yarn for hook-like engagement elements, and a multifilament yarn for loop-like engagement elements, the following yarns were prepared.

[Ground Warp Yarn]

a multifilament yarn of polyethylene terephthalate having a melting point of 260° C.

total decitex and the number of filaments: 167 dtex and 30 filaments [Ground Weft Yarn (Thermal Adhesive Multifilament Yarn Composed of Core-Sheath Type Composite Fibers)]

core component: polyethylene terephthalate (melting point: 260° C.)

sheath component: isophthalic acid 25 mol % polyethylene terephthalate copolymer (softening point: 190° C.)

core-sheath ratio (weight ratio): 70:30 total decitex and the number of filaments: 116 dtex and 24 filaments dry heat shrinkage rate at 200° C.: 13%

[Monofilament Yarn for Hook-Like Engagement Elements]

polybutylene terephthalate fibers (melting point: 220° C.)

fineness: 410 dtex (diameter: 0.20 mm)

[Multifilament Yarn for Loop-Like Engagement Elements]

polybutylene terephthalate fibers (melting point: 220° C.)

total decitex and the number of filaments: 265 dtex and 7 fibers

A double-sided engagement type fabric surface fastener, in which an area (A) on which hook-like engagement elements exist, and an area (B), adjacent to the area (A), on which loop-like engagement elements exist on the back surface were alternately formed, was manufactured in the following conditions with use of the aforementioned four types of yarns.

[Area (A) where Hook-Like Engagement Elements Exist]

The area (A) was woven with use of the ground warp yarn, the ground weft yarn, and the monofilament yarn for hook-like engagement elements, with use of plain fabrics as a weaving structure, and with a weaving density (after heat shrinkage treatment) of 55 ground warp yarns/cm and 20 ground weft yarns/cm. A monofilament yarn for hook-like engagement elements was woven with respect to each four ground warp yarns in parallel to the ground warp yarns, and a loop was formed on the base fabric by allowing the monofilament yarn to cross over three consecutive ground warp yarns after floating over and sinking under three ground weft yarns, so that the loop was formed at a position where the yarn crossed over the three consecutive ground warp yarns.

[Area (B) where Loop-Like Engagement Elements Exist]

The area (B) was woven with use of the ground warp yarn, the ground weft yarn, and the monofilament yarn for loop-like engagement elements, by using plain fabrics as a weaving structure, and with a weaving density (after heat shrinkage treatment) of 55 ground warp yarns/cm and 20 ground weft yarns/cm. A multifilament yarn for loop-like engagement elements was woven with respect to each four ground warp yarns in parallel to the ground warp yarns, and a loop was formed on the base fabric by allowing the multifilament yarn to cross over one ground warp yarn after floating over and sinking under one ground weft yarn, so that the loop was formed at a position where the yarn crossed over the one ground warp yarn. It should be noted that the yarn for hook-like engagement elements and the yarn for loop-like engagement elements do not cross each other, and do not come into contact with each other.

A double-sided engagement type fabric surface fastener was manufactured by simultaneously weaving the area (A) and the area (B), without individually weaving the area (A) and the area (B). Specifically, a surface fastener, in which the area (A) and the area (B) alternately exist, was manufactured by weaving a ground weft yarn concurrently into the area (A) and the area (B). More specifically, as illustrated in FIG. 1, as viewed from the cross section of the surface fastener tape, the fastener tape is woven to allow the area (A) and the area (B) to alternately exist in such a manner that, next to a hook-like engagement element array area (A: four ground warp yarns+one yarn for hook-like engagement elements), there exists a loop-like engagement element array area (B: four ground warp yarns+one yarn for loop-like engagement elements); next to the loop-like engagement element array area, there exists a hook-like engagement element array area (A: four ground warp yarns+one yarn for hook-like engagement elements); and then, next to the hook-like engagement element array area, there exists a loop-like engagement element array area (B: four ground warp yarns+one yarn for loop-like engagement elements). Loop-like engagement elements exist on the surface opposite to the surface where hook-like engagement elements exist. It should be noted that the hook-like engagement elements and the loop-like engagement elements do not cross each other and do not come into contact with each other.

The fabric for a double-sided engagement type fabric surface fastener tape woven in the aforementioned conditions was subjected to a heat treatment in a temperature zone i.e. at 200° C., at which only the sheath component of ground weft yarn was thermally melted, and the ground warp yarn, the monofilament yarn for hook-like engagement elements, the multifilament yarn for loop-like engagement elements, and the core component of ground weft yarn were not thermally melted. The ground weft yarn was largely shrunk, and the sheath component was melted to adhere the yarn nearby. As a result, the base fabric was shrunk by 9% in the ground weft yarn direction. Then, after the obtained fabric was cooled, the leg portions of the loops for hook-like engagement elements were cut to form the hook-like engagement elements.

The density of hook-like engagement elements of the thus obtained double-sided engagement type fabric surface fastener was 30 elements/cm$^2$. The height of a hook-like engagement element from the base fabric surface was 1.7 mm. The density of loop-like engagement elements was 60 elements/cm$^2$. The height of a loop-like engagement element from the base fabric surface was 1.8 mm.

The thus obtained double-sided engagement type fabric surface fastener was dyed to navy blue in a high-pressure condition capable of dyeing polyethylene terephthalate fibers. As a result of dyeing, the surface fastener could be dyed to high-grade deep navy blue, without uneven dyeing.

As compared with a conventional general surface fastener, in which resin (resin for back coat) for preventing pulling out of engagement elements was coated on the back surface, the base fabric of the dyed double-sided engagement type fabric surface fastener was soft. The double-sided engagement type fabric surface fastener was immersed in water for 10 minutes, and taken out of the water. The shape and the engaging strength did not change at all. The base fabric retained a flat state. The hook-like engagement elements and the loop-like engagement elements were aligned in a predetermined direction. No foreign matter was adhered to the surface of the engagement elements. The external appearance was quite good.

Next, the engaging strength of the thus obtained surface fastener was measured. A result of the measurement is illustrated in Table 1. The engaging strength was measured in two directions i.e. the shearing direction and the disengagement direction of the surface fastener having a width of 80 mm. Further, engagement and disengagement of the surface fasteners was repeated 2,000 times. After the repeated engagement and disengagement, loss of loop-like engagement elements from the base fabric, and loop fiber split were observed. A result of the observation is illustrated in Table 1.

As is obvious from Table 1, the hook-and-loop integral fastener of the present example has a large engaging strength. As a result of observing the surface fastener after 2,000-times engagement and disengagement, loss of engagement elements observed only slightly and loop fiber split hardly appeared. Thus, the external appearance and the engaging strength were not affected.

Examples 2 to 4

A surface fastener was manufactured in the same manner as in Example 1, except that the density of loop-like engagement elements was changed to 40 elements/cm$^2$ by reducing formation of loops of loop-like engagement elements constituting a loop-like engagement element array area in Example 1 (Example 2).

Further, a surface fastener was manufactured in the same manner as in Example 1, except that the density of hook-like engagement elements was changed to 60 elements/cm$^2$ by changing the number of yarns for hook-like engagement elements constituting a hook-like engagement element array area in Example 1 (Example 3).

Furthermore, a surface fastener was manufactured in the same manner as in Example 1, except that the density of loop-like engagement elements was changed to 100 elements/cm$^2$ by increasing the number of yarns for loop-like engagement elements constituting a loop-like engagement element array area, and by increasing the number of loops for loop-like engagement elements in Example 1 (Example 4).

As well as Example 1, the external appearance and the engaging strength of the dyed surface fasteners, loss of loop-like engagement elements and loop fiber split after 2,000-times engagement and disengagement were observed. Results of the observation is illustrated in Table 1.

As is illustrated in Table 1, the engaging strengths in Examples 2 to 4 were slightly lowered, as compared with Example 1. However, regarding loss of engagement elements, Examples 2 to 4 were slightly superior to Example 1. Further, in all the surface fasteners of Examples 2 to 4, loop fiber split hardly appeared. Regarding the external appearance, all the surface fasteners of Examples 2 to 4 were good, without uneven dyeing.

In particular, in Example 2, the density of loop-like engagement elements was small, as compared with Example 1. Therefore, it was less likely that a hook-like engagement element engages with a loop-like engagement element. Presumably, this reduced the total number of hook-like engagement elements in engagement with loop-like engagement elements, and lowered the engaging strength.

In Example 3, since the density of hook-like engagement elements increased, it was expected that the total number of hook-like engagement elements in engagement with loop-like engagement elements increased. However, when the engagement surface was observed, only the top parts of the hook-like engagement elements and the top parts of the loop-like engagement elements came into contact with each other, and in many regions, the hook-like engagement elements and the loop-like engagement elements did not deeply enter into counterpart engagement elements. Presumably, this is because the density of hook-like engagement elements and the density of loop-like engagement elements are too high.

Further, in Example 4, since the density of loop-like engagement elements increased, it was expected that the total number of loop-like engagement elements in engagement with hook-like engagement elements increased. However, when the engagement surface was observed, as well as Example 3, only the top parts of the hook-like engagement elements and the top parts of the loop-like engagement elements came into contact with each other, and in many regions, the hook-like engagement elements and the loop-like engagement elements did not deeply enter into counterpart engagement elements. Presumably, this is because the density of loop-like engagement elements is too high, the loop-like engagement elements are not sufficiently spread. This reduces the number of engaged hook-like engagement elements.

In Examples 2 to 4, presumably, because of no or less clearance between engagement elements, it is less likely that the hook-like engagement elements and the loop-like engagement elements enter into the clearance of the engagement elements in the length direction. As a result, the total number of engaged elements reduces, and the engaging strength is lowered.

Regarding loss of engagement elements after 2,000-times engagement and disengagement, in the surface fastener of Example 1, loss of fibers of a yarn for loop-like engagement elements slightly appeared, as compared with Examples 2 to 4. Presumably, this is because in the surface fastener of Example 1, considering the initial engaging strength, the number of loop-like engagement elements which may be pulled out is large, because the number of loop-like engagement elements in engagement with hook-like engagement elements is large.

Example 5

A surface fastener was manufactured in the same manner as in Example 1, except that a polyethylene terephthalate monofilament yarn (melting point: 260° C., fineness: 298 dtex, diameter: 0.17 mm) for hook-like engagement elements was used, and a polyethylene terephthalate multifilament yarn (melting point: 260° C., fineness: 265 dtex, number of filaments: 7 filaments) for loop-like engagement elements was used in Example 1.

As well as Example 1, the engaging strength of the obtained surface fastener, loss of loop-like engagement elements, and the presence or absence of loop fiber split after 2,000-times engagement and disengagement were observed. Further, the external appearance was also observed. A result of the observation is illustrated in Table 1.

In Example 5, the yarn for hook-like engagement elements is a polyethylene terephthalate monofilament yarn. Therefore, taking into consideration the feature of rigid polyethylene terephthalate fibers, the fineness was intentionally increased, as compared with Example 1.

As is obvious from the result illustrated in Table 1, the initial engaging strength is small, as compared with Example 1. However, the overall engaging strength is as good as Examples 2 to 4. Further, loss of engagement elements after 2,000-times disengagement is substantially the same as in Example 1. Further, loop fiber split hardly appeared.

The engaging/disengaging strength was lowered as compared with Example 1. Presumably, the engaging strength shows a low value because the multifilament yarn retains a bundled state, without separation of the filaments of the multifilament yarn constituting loop-like engagement elements. Further, regarding the external appearance, Example 5 has a high-grade appearance, as well as Examples 1 to 3. This evaluation did not change even in a wet condition.

TABLE 1

| | Ex 1 | Ex 2 | Ex 3 | Ex 4 | Ex 5 | C Ex 1 | C Ex 2 |
|---|---|---|---|---|---|---|---|
| yarn for hook elements | PBT | PBT | PBT | PBT | PET | PBT | PBT |
| (diameter: mm) | 0.20 | 0.20 | 0.20 | 0.20 | 0.17 | 0.20 | 0.20 |
| hook density (elements/cm$^2$) | 30 | 30 | 60 | 30 | 30 | 30 | 30 |
| yarn for loop elements | PBT | PBT | PBT | PBT | PET | PBT | PBT |
| (dtex/f) | (265/7) | (265/7) | (265/7) | (265/7) | (265/7) | (265/7) | (265/7) |
| loop density (elements/cm$^2$) | 60 | 40 | 60 | 100 | 60 | 60 | 60 |
| formation positions of hook elements and loop elements | a hook element is formed at a position where a yarn crosses over three ground warp yarns, and a loop element is formed at a position where a yarn crosses over one ground warp yarn | | | | | | |
| thermal adhesive fibers | ground weft yarn | ground weft yarn | ground weft yarn | ground weft yarn | ground weft yarn | not used | ground warp yarn |
| engaging strength/shearing (N/cm$^2$) | 6.66 | 5.25 | 3.83 | 4.60 | 5.10 | 5.20 | 5.05 |
| engaging strength/peeling (N/cm) | 0.58 | 0.48 | 0.46 | 0.46 | 0.34 | 0.46 | 0.44 |
| loss of loop-like engagement elements after 2,000-times engagement/disengagement | slightly appear | hardly appear | hardly appear | hardly appear | slightly appear | slightly appear | remarkably appear |
| loop fiber split of engagement elements after 2,000-times engagement/disengagement | hardly appear | hardly appear | hardly appear | hardly appear | hardly appear | hardly appear | hardly appear |
| external appearance before disengagement/engagement | very good | very good | very good | very good | very good | white powder no softness | vertical streaks appear |

In Table, PET stands for polyethylene terephthalate, and PBT stands for polybutylene terephthalate.

Comparative Example 1

A double-sided engagement type fabric surface fastener was manufactured by the same method as in Example 1, except that an ordinary 120-decitex/24 filaments non-thermal adhesive polyethylene terephthalate multifilament yarn was used as a ground weft yarn, in place of thermal adhesive fibers, and polyurethane emulsion liquid of 45 g/m$^2$ in solid content was spray-coated on the hook-like engagement element surface in Example 1. The performance of the obtained surface fastener is illustrated in Table 1.

In Comparative Example 1, the performance of the surface fastener has no serious problem. However, part of polyurethane adhesive adhered to the surface of the hook-like engagement elements was peeled off, and white powder resin adhesive appeared as if dust fell on the surface. Further, white powder generation increased by repeated engagement and disengagement. This made the fastener look cheap. Further, as compared with Examples 1 to 4, the surface fastener itself was hard, and lacked softness. As a dyed article, a polyurethane layer exists on the hook-like engagement element surface of the base fabric, and on the surface of the hook-like engagement elements. The polyurethane layer, the engagement elements covered by the polyurethane layer, and the base fabric were not sufficiently dyed, and the top surface and the bottom surface of the base fabric had a difference in dyeing effect. This failed to give a high-grade appearance.

Comparative Example 2

A double-sided engagement type fabric surface fastener was manufactured by the same method as in Example 1, except that thermal adhesive fibers used in Example 1 was used as a yarn adjacent to a yarn for engagement elements among the ground warp yarns, and the polyethylene terephthalate multifilament yarn used in Comparative Example 1 was used as a ground weft yarn in Example 1.

In the thus obtained surface fastener, heat shrinkage occurred in the ground warp yarn by thermal adhesion during the manufacturing process, and managing the manufacturing process was difficult. The obtained surface fastener locally had a wavy appearance, and the external appearance was poor. Further, the loop-like engagement elements were pulled out of the base fabric surface by 2,000-times engagement and disengagement. The engaging strength was largely lowered, and the surface fastener was far from satisfaction to the consumers. Furthermore, vertical streaks clearly appeared in the warp yarn direction. Thus, the appearance was not satisfactory at all. A result of the observation is illustrated in Table 1.

Comparative Example 3

As a ground warp yarn and a ground weft yarn constituting a base fabric, a monofilament yarn for hook-like engagement elements, and a multifilament yarn for loop-like engagement elements, the following yarns were prepared.

[Ground Warp Yarn]

a multifilament yarn of nylon 6 having a melting point of 225° C.

total decitex and the number of filaments: 155 dtex and 12 filaments

[Ground Weft Yarn]

same as the ground warp yarn

[Monofilament Yarn for Hook-Like Engagement Elements]

monofilament yarn of nylon 66 (melting point: 235° C.)

dtex (diameter: 0.20 mm)

[Multifilament Yarn for Loop-Like Engagement Elements]

multifilament yarn of nylon 6 (melting point: 225° C.)

total decitex and the number of filaments: 235 dtex and 10 fibers

A surface fastener was woven with use of the aforementioned four types of yarns in the same weaving condition as in Example 1. A heat treatment was applied with use of vapors at 195° C. at which nylon did not cause thermal degradation to fix the loop shape. Further, in order to fix the engagement elements to the base fabric, polyurethane emulsion liquid was coated on the hook-like engagement element surface by an airless spray method, and the surface was dried. Then, the leg portions of the loops for hook-like engagement elements were cut to form the hook-like engagement elements. The thus obtained surface fastener was dyed to deep navy blue in a dyeing condition of polyamide fabric.

The density of engagement elements and the height of an engagement element of the thus obtained surface fastener were substantially the same as in Example 1. As well as Example 1, the external appearance of the hook surface, the engaging strength, and the external appearance after 2,000-times engagement and disengagement of the thus obtained surface fastener were observed.

As a result of the observation, regarding the external appearance, the adhesive for element fixation coated on the hook-like engagement element surface was peeled off from the yarn for hook-like engagement elements, and the peeled-off adhesive looked like white powder. After repeated engagement and disengagement, the peeling off of adhesive was accelerated, and white powder generation increased. Further, presumably because of uneven spray-coating, the hook-like engagement element surface looked unnaturally glossy due to non-uniformity in the coated amount of adhesive in the width direction. The external appearance of the fastener tape was hardly satisfactory.

Comparative Example 4

A surface fastener was manufactured in the same manner as in Comparative Example 1, except that a polyethylene terephthalate monofilament yarn (melting point: 260° C., fineness: 298 dtex, diameter: 0.17 mm) for hook-like engagement elements was used, and a polyethylene terephthalate multifilament yarn (melting point: 260° C., fineness: 265 dtex, number of filaments: 7 filaments) for loop-like engagement elements was used in Comparative Example 3.

As well as Example 1, the external appearance and the engaging strength of the thus obtained surface fastener, and the external appearance after 2,000-times engagement and disengagement were observed. As a result of the observation, as well as Comparative Example 3, white powder due to peeling off of adhesive for element fixation was generated. After repeated engagement and disengagement, white powder generation increased, as well as Comparative Example 3. Further, unnatural gloss due to uneven coating appeared, as well as Comparative Example 3. Thus, the external appearance was hardly satisfactory.

Example 6

A surface fastener was manufactured by the same method as in Example 4, except that one-third of hook-like engagement elements on the base fabric surface were equally sorted out, and the sorted engagement elements were cut from the root for removal, so that the density of hook-like engagement elements was reduced to 20 elements/$cm^2$ in Example 4.

Example 7

A surface fastener was manufactured by the same method as in Example 1, except that a multifilament yarn of 15 filaments, which is used as a yarn for loop-like engagement elements of a conventional general surface fastener, namely, a 265 dtex/15 filaments polybutylene terephthalate multifilament yarn having a melting point of 220° C. was used in place of the multifilament yarn constituting loop-like engagement elements in Example 1.

Example 8

A surface fastener was manufactured by the same method as in Example 1, except that the formation position of a hook-like engagement element i.e. a position where a yarn crosses over three consecutive ground warp yarns in Example 1 was replaced by a position where a yarn crosses over one ground warp yarn to form a loop for a hook-like engagement element at the position; and the formation position of a loop-like engagement element i.e. a position where a yarn crosses over one ground warp yarn in Example 1 was replaced by a position where a yarn does not cross over a ground warp yarn to form a loop for a loop-like engagement element at the position.

As well as Examples 1 to 5, regarding the surface fasteners obtained in Examples 6 to 8, the external appearance and the engaging strength of the dyed surface fasteners, loss of loop-like engagement elements, and loop fiber split of engagement elements after 2,000-times engagement and disengagement were observed. A result of the observation is illustrated in Table 2.

TABLE 2

| | Example 6 | Example 7 | Example 8 |
|---|---|---|---|
| yarn for hook elements | PBT | PBT | PBT |
| (diameter: mm) | 0.20 | 0.20 | 0.20 |
| hook density (elements/cm$^2$) | 20 | 30 | 30 |
| yarn for loop elements | PBT | PBT | PBT |
| (dtex/f) | (265/7) | (265/15) | (265/7) |
| loop density (elements/cm$^2$) | 100 | 60 | 60 |
| formation positions of hook elements and loop elements | a hook element is formed at a position where a yarn crosses over three ground warp yarns, and a loop element is formed at a position where a yarn crosses over one ground warp yarn | | a hook element is formed at a position where a yarn crosses over one ground warp yarn, and a loop element is formed without crossing over a ground warp yarn |
| thermal adhesive fibers | ground weft yarn | ground weft yarn | ground weft yarn |
| engaging strength/shearing (N/cm$^2$) | 4.10 | 5.75 | 4.60 |
| engaging strength/peeling (N/cm) | 0.42 | 0.52 | 0.47 |
| loss of loop-like engagement elements after 2,000-times engagement/disengagement | hardly appear | slightly appear | hardly appear |
| loop fiber split of engagement elements after 2,000-times engagement/disengagement | hardly appear | slightly appear | hardly appear |
| external appearance before disengagement/engagement | very good | very good | very good |

As is obvious from Table 2, the engaging strengths in Examples 6 to 8 were slightly lowered, as compared with Example 1. However, regarding the external appearance, all of the surface fasteners of Examples 6 to 8 have good appearance as well as Example 1, without uneven dyeing.

In particular, in Example 6, the number of loop-like engagement elements is larger than the number of hook-like engagement elements. However, when the engagement state was observed, although the top parts of the hook-like engagement elements and the top parts of the loop-like engagement elements sufficiently came into contact with each other, the number of hook-like engagement elements and loop-like engagement elements that deeply entered into counterpart engagement elements was not so large. The engaging strength was slightly lowered, as compared with Example 1. Regarding resistance against pulling out of loop-like engagement elements, and resistance against fiber split, Example 6 was substantially the same as Example 1.

Further, in Example 7, a multifilament yarn whose filament number was as large as the filament number of a multifilament yarn used in a conventional general surface fastener was used as a multifilament yarn constituting loop-like engagement elements. Since the filament number was large, thermal adhesive resin used in the ground weft yarn did not sufficiently infiltrate into the multifilament yarn for loop-like engagement elements, and loss of loop-like engagement elements after 2,000-times engagement and disengagement slightly appeared. Since the diameter of each fiber constituting the multifilament yarn for loop-like engagement elements was small, the strength of each fiber was weakened. Fiber split of the multifilament yarn for loop-like engagement elements was slightly observed.

Further, in Example 8, the alignment directions of hook-like engagement elements and loop-like engagement elements seem to be unsuitable for engagement. As a result, presumably, the number of engaged engagement elements is small, as compared with Example 1, and a large engaging strength is not obtained. Regarding resistance against pulling out of loop-like engagement elements and resistance against fiber split, Example 8 is substantially the same as Example 1.

The present application is based on Japanese Patent Application No. 2012-216238 filed on Sep. 28, 2012, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

INDUSTRIAL APPLICABILITY

The present invention has a wide industrial applicability in the technical field pertaining to surface fasteners.

The invention claimed is:

1. A fabric surface fastener of a double-sided engagement type, comprising:

a base fabric;

hook-like engagement elements that exist on a top surface of the base fabric; and loop-like engagement elements that exist on a bottom surface of the base fabric, wherein a ground warp yarn and a ground weft yarn constituting the base fabric, the hook-like engagement elements, and the loop-like engagement elements are all yarns made of a polyester resin, the ground weft yarn comprises core-sheath type thermal adhesive polyester fibers, the hook-like engagement elements and the loop-like engagement elements are both fixed to the base fabric by the thermal adhesive fibers constituting the base fabric, the hook-like engagement element is formed at a position where a yarn for hook-like engagement element crosses over three consecutive ground warp yarns, and the loop-like engagement element is formed at a position where a yarn for loop-like engagement elements crosses over one ground warp yarn.

2. The fabric surface fastener according to claim 1, wherein a ratio of element density between the hook-like engagement elements and the loop-like engagement elements is in a range of from 1:1.3 to 1:4.

3. The fabric surface fastener according to claim 1, wherein a density of the loop-like engagement elements is in a range of from 40 to 100 elements/$cm^2$ per multifilament yarn.

4. The fabric surface fastener according to claim 1, wherein a yarn for hook-like engagement elements and a yarn for loop-like engagement elements are alternately woven into the base fabric in parallel to the ground warp yarn in a ground weft yarn direction.

5. The fabric surface fastener according to claim 1, wherein a yarn for hook-like engagement elements and a yarn for loop-like engagement elements are alternately woven into the base fabric with respect to each four ground warp yarns, and the yarn for hook-like engagement elements and the yarn for loop-like engagement elements do not cross each other or do not come into contact with each other on the base fabric.

6. The fabric surface fastener according to claim 1, wherein the fabric surface fastener has a weaving structure such that after a hook-like engagement element is formed, the yarn for hook-like engagement elements sinks under a first succeeding ground weft yarn, floats over a second succeeding ground weft yarn, sinks under a third succeeding ground weft yarn, and floats over the surface of the base fabric between the third succeeding ground weft yarn and a fourth succeeding ground weft yarn, whereby a hook-like engagement element is formed at a position where the yarn for hook-like engagement elements crosses over three consecutive ground warp yarns at a position adjacent to the preceding hook-like engagement element, and after a loop-like engagement element is formed, the yarn for loop-like engagement elements sinks under a first succeeding ground weft yarn, and floats over the surface of the base fabric between the first succeeding ground weft yarn and a second succeeding ground weft yarn, whereby a loop-like engagement element is formed at a position where the yarn for loop-like engagement elements crosses over one ground warp yarn at a position adjacent to the preceding loop-like engagement element.

7. The fabric surface fastener according to claim 1, wherein the yarn for hook-like engagement elements is a monofilament yarn, the yarn for loop-like engagement elements is a multifilament yarn, and the yarn for hook-like engagement elements and the yarn for loop-like engagement elements are both yarns made of a polybutylene terephthalate resin.

8. The fabric surface fastener according to claim 1, wherein the yarn for hook-like engagement elements is a monofilament yarn having a diameter in a range of from 0.15 to 0.30 mm, and the yarn for loop-like engagement elements is a multifilament yarn of 5 to 9 filaments and having a total decitex of 150 to 350 decitex.

9. A fabric surface fastener of double-sided engagement type, comprising:

a base fabric;

hook-like engagement elements that exist on a top surface of the base fabric; and loop-like engagement elements that exist on a bottom surface of the base fabric, wherein a ground warp yarn and a ground weft yarn constituting the base fabric, the hook-like engagement elements, and the loop-like engagement elements are all yarns made of a polyester resin, the ground weft yarn comprises core-sheath type thermal adhesive polyester fibers, the hook-like engagement elements and the loop-like engagement elements are both fixed to the base fabric by the thermal adhesive fibers constituting the base fabric, and a ratio of element density between the hook-like engagement elements and the loop-like engagement elements is in a range of from 1:1.3 to 1:4.

* * * * *